US005461653A

United States Patent [19]

Parker

[11] Patent Number: 5,461,653

[45] Date of Patent: Oct. 24, 1995

[54] METHOD AND APPARATUS FOR ENHANCED SENSITIVITY FILMLESS MEDICAL X-RAY IMAGING, INCLUDING THREE-DIMENSIONAL IMAGING

[75] Inventor: Sherwood Parker, Berkeley, Calif.

[73] Assignee: University of Hawaii, Honolulu, Hi.

[21] Appl. No.: 147,401

[22] Filed: Nov. 5, 1993

[51] Int. Cl.[6] ..... G21K 1/00

[52] U.S. Cl. ..... 378/22; 378/21; 378/155

[58] Field of Search ..... 378/21, 22, 23, 378/24, 25, 26, 27, 41, 98.8, 145, 149, 154, 155; 250/370.09

[56] References Cited

U.S. PATENT DOCUMENTS

| | | | |
|---|---|---|---|
| 4,234,794 | 11/1980 | Voinea et al. | 378/22 X |
| 4,349,740 | 9/1982 | Grassmann et al. | 378/22 X |
| 4,399,509 | 8/1983 | Hounsfield | 378/21 X |
| 4,651,002 | 3/1987 | Anno | 378/155 X |
| 5,237,197 | 8/1993 | Snoeys et al. . | |

*Primary Examiner*—David P. Porta
*Attorney, Agent, or Firm*—Flehr, Hohbach, Test, Albritton & Herbert

[57] ABSTRACT

A filmless X-ray imaging system includes at least one X-ray source, upper and lower collimators, and a solid-state detector array, and can provide three-dimensional imaging capability. The X-ray source plane is distance $z_1$ above upper collimator plane, distance $z_2$ above the lower collimator plane, and distance $z_3$ above the plane of the detector array. The object to be X-rayed is located between the upper and lower collimator planes. The upper and lower collimators and the detector array are moved horizontally with scanning velocities $v_1$, $v_2$, $v_3$ proportional to $z_1$, $z_2$ and $z_3$, respectively. The pattern and size of openings in the collimators, and between detector positions is proportional such that similar triangles are always defined relative to the location of the X-ray source. X-rays that pass through openings in the upper collimator will always pass through corresponding and similar openings in the lower collimator, and thence to a corresponding detector in the underlying detector array. Substantially 100% of the X-rays irradiating the object (and neither absorbed nor scattered) pass through the lower collimator openings and are detected, which promotes enhanced sensitivity. A computer system coordinates repositioning of the collimators and detector array, and X-ray source locations. The computer system can store detector array output, and can associate a known X-ray source location with detector array output data, to provide three-dimensional imaging. Detector output may be viewed instantly, stored digitally, and/or transmitted electronically for image viewing at a remote site.

23 Claims, 5 Drawing Sheets

METHOD AND APPARATUS FOR ENHANCED SENSITIVITY FILMLESS MEDICAL X-RAY IMAGING, INCLUDING THREE-DIMENSIONAL IMAGING

The government has certain rights in this invention pursuant to U.S. Department of Energy contract no. DE-AC03-83ER40103.

FIELD OF THE INVENTION

The present invention relates to X-ray imaging in general, and to enhanced sensitivity filmless mammography X-ray imaging, including three-dimensional imaging, in particular.

BACKGROUND OF THE INVENTION

X-ray imaging can be a useful medical diagnostic tool. In mammography, for example, X-rays are used in an attempt to detect cancerous tissue at the earliest possible growth stage. If identified sufficiently early, such tissue can be treated or surgically removed, improving the patient's prospects for long term survival.

Unfortunately existing mammography X-ray imaging cannot detect small cancerous tissue and microcalcifications that may be an indication of malignancy until they are sufficiently large to register upon the X-ray film. In practice, existing mammography imaging systems use X-ray dosages of about 100 millirad to the X-rayed tissue, but cannot reliably detect microcalcifications smaller than about 200 μm (0.20 mm).

The first art X-ray systems exhibited poor sensitivity, due to loss of useful X-rays in reaching the X-ray film, and due to the low sensitivity of the X-ray film itself. In practice, a scintillation screen is placed atop the X-ray film such that impinging X-rays cause the scintillation screen to flash, exposing the underlying X-ray film. The scintillation screen must be thick enough to stop all incoming X-rays, but unfortunately the flashed light spreads out within the thickness of the scintillation screen enroute to the underlying film. Thus, while the scintillation screen/film combination enhances detection sensitivity compared to using the X-ray film alone, detection of small sized particles in impaired because of the scintillation screen thickness.

In short, although microcalcifications smaller than 0.2 mm may indicate the presence of breast cancer, such small targets cannot be detected with existing X-ray systems.

FIG. 1 depicts a conventional X-ray imaging system wherein a stationary X-ray source 2 emits X-rays 4 that pass through an opening 6 in a stationary upper collimator 8 that limits the radiation field to the size of the patient object 10 under examination. Object 10 may include a tissue region 12 possible including microcalcifications, whose presence is sought to be detected with the X-ray system.

Radiation passing through upper collimator 8 includes X-rays 14 that scatter due to the Compton effect, and direct X-rays 16. Although it would be beneficial to detect and thus use all of the X-rays that have irradiated object or patient 10, the prior art normally uses a lower collimator 18 to prevent the scattered X-rays from reaching the scintillation screen/film detector 20 located below the lower collimator. Lower collimators 18 such as shown in FIG. 1 are commonly called Bucky units.

As a result, only direct X-rays passing through narrow lower collimator openings or slits 22 without being absorbed are detected by the stationary detection medium 20. Stated differently, the prior art's reliance upon lower collimator 18 means that many X-rays that have irradiated the patient, that have not scattered and thus carry useful information, will be absorbed by the lower collimator 18 rather than pass through the lower collimator openings 22 to be detected. Some prior art systems may in fact can detect only about half of the X-rays exiting the subject 10.

This inability to detect all of the X-rays irradiating the patient contributes to lowered sensitivity for prior art systems. For example, a sufficiently small tumor or microcalcification within a tumor 12 in the object 10 may go undetected, notwithstanding that it may be cancerous. Although substantial, but relatively safe, levels of X-ray radiation are used in prior art systems to compensate for absorption in the lower collimator, nonetheless considerably more X-rays are needed.

Further, it will be appreciated that prior art detecting media, e.g., scintillating screen/film 20, in addition to degrading resolution sensitivity for tiny targets, provide an integration function. Essentially, direct X-rays that pass through openings in the lower collimator are integrated over time. There is no ability to distinguish X-rays arriving at one angle or at one time from X-rays arriving at a second angle or at a second time. Such ability would permit suspicious appearing targets 12 to be imaged from several angles, to provide an image locating the target in three-dimension breast space. A target that is not visible at one angle may in fact be visible when imaged at a different angle. Because of the integrating nature of prior art detecting media, three-dimensional imaging is barely feasible in the prior art. At best, two separate X-ray exposures are made at slightly different angles, and the two resulting X-ray films are superimposed and matched stereoscopically by hand. Needless to say, such manual matching does not permit computer analysis of the detected image, which analysis might readily detect suspicious targets likely to be missed by the human eye.

An additional limitation of prior art detection media 20 is that it is difficult to readily transmit copies of the detected image to remote locations. For example, a physician in a remote area might wish to consult with a specialist thousands of miles away with regard to a suspicious mammogram. In the prior art, the X-ray film is mailed to the specialist, or a copy made (with resultant image degradation) and mailed. At best, it will take hours or days before the specialist receives the image and can render an opinion to the examining physician. Although high resolution equipment that can scan an X-ray film and transmit the scanned data is being developed, such scanning equipment is relatively expensive and not readily available to many medical practitioners, especially practitioners in poorer countries.

In summary, there is a need for an X-ray system that can provide enhanced X-ray sensitivity, enhanced small target resolution, and preferably is filmless. Such system preferably would provide a detected image that can be electronically copied, stored, and/or transmitted rapidly over great distances. Further, there is a need for an X-ray system that, in addition to having the above advantages, can also provide three-dimensional imaging.

The present invention discloses such a system, and a method for implementing its use.

SUMMARY OF THE INVENTION

The present invention provides an X-ray source, upper and lower collimators, and a solid-state detector array. The X-ray source is located on a reference plane a vertical distance $z_1$ above the plane of the upper collimator, a vertical distance $z_2$ above the plane of the second collimator, and a vertical distance $z_3$ above the plane of the detector array. The object to be X-rayed is located between the upper and lower collimator planes.

The detectors preferably are fabricated on a charge depletable substrate having well region-separated collection electrodes on one substrate surface, PN junction regions on the other substrate surface, and detector electronics fabricated in the well regions. Such detectors are described in U.S. Pat. No. 5,237,197, wherein applicant is a co-inventor. Because they collect X-ray generated charge over almost all of a several hundred micron substrate thickness, and can be fabricated in multi-layer systems, such detectors can provide good sensitivity.

The detector outputs represent quantized detection data that may be processed, stored, viewed, analyzed and transmitted digitally. Because the detector pixel size is small, and because the detector thickness typically is a few hundred microns, spatial resolution and detection sensitivity for small targets is excellent, providing the X-rays are incident in a range of angles close to the normal to the surface.

Because the detectors do not integrate incoming radiation, a three-dimensional imaging mode may be used. In such mode, the X-ray source and object under examination are stationary, but the upper collimator, lower collimator and detector array are moved horizontally with scanning velocities $v_{x1}$, $v_{x2}$, $v_{x3}$ that are proportional to their respective vertical distance along the z-axis from the X-ray source plane. If desired, the upper collimator, lower collimator and detector array may also be simultaneously moved with scanning velocities $v_{y1}$, $v_{y2}$, $v_{y3}$ (again proportional to their respective vertical z-axis distances from the X-ray source plane), and/or rotated horizontally through an angle $\theta$ about the z-axis. The horizontal distance between adjacent openings in the upper collimator, between adjacent openings in the lower collimators, and between adjacent detector positions, and the horizontal size of such openings and detectors are proportionally scaled such that similar triangles are always defined relative to the location of the X-ray source.

The X-ray source is effectively horizontally repositionable a distance proportional to the inter-opening spacing in the upper collimator multiplied by the ratio between the X-ray source to detector lower collimator vertical distance divided by the vertical distance separating the upper and lower collimators. The X-ray source may be a single source that is repositioned horizontally, multiple sources spaced-apart horizontally, or a target material scanned with an electron beam to produce X-rays at horizontally spaced-apart locations. It is sufficient that X-ray source repositioning occur in significantly less time than it takes a collimator opening or a detector to be moved with width of such opening or detector.

Because the geometry of the present invention is such that similar triangles are formed, X-rays that pass through openings in the upper collimator will always pass through corresponding and similar openings in the lower collimator, and thence to a corresponding detector in the underlying detector array. As a result, substantially 100% of the X-rays irradiating the object pass through the lower collimator openings and are detected, which promotes enhanced detection sensitivity.

Preferably a computer system co-ordinates horizontal repositioning of the collimators and detector array, as well as X-ray source repositioning. The computer system further can store detector array output, and can associate a known X-ray source location with detector array output data, thereby enabling three-dimensional imaging. The detector output may be viewed instantly, stored digitally, and/or transmitted rapidly over a modem for image viewing at a remote site. Further, the X-ray data may be computer processed using algorithms to help locate suspicious regions, and to permit zoom-enlargement and contrast adjustment for areas of interest.

Other features and advantages of the invention will appear from the following description in which the preferred embodiments have been set forth in detail, in conjunction with the accompanying drawings.

DETAILED DESCRIPTION OF THE PREFERRED EMBODIMENTS

Figure 2:
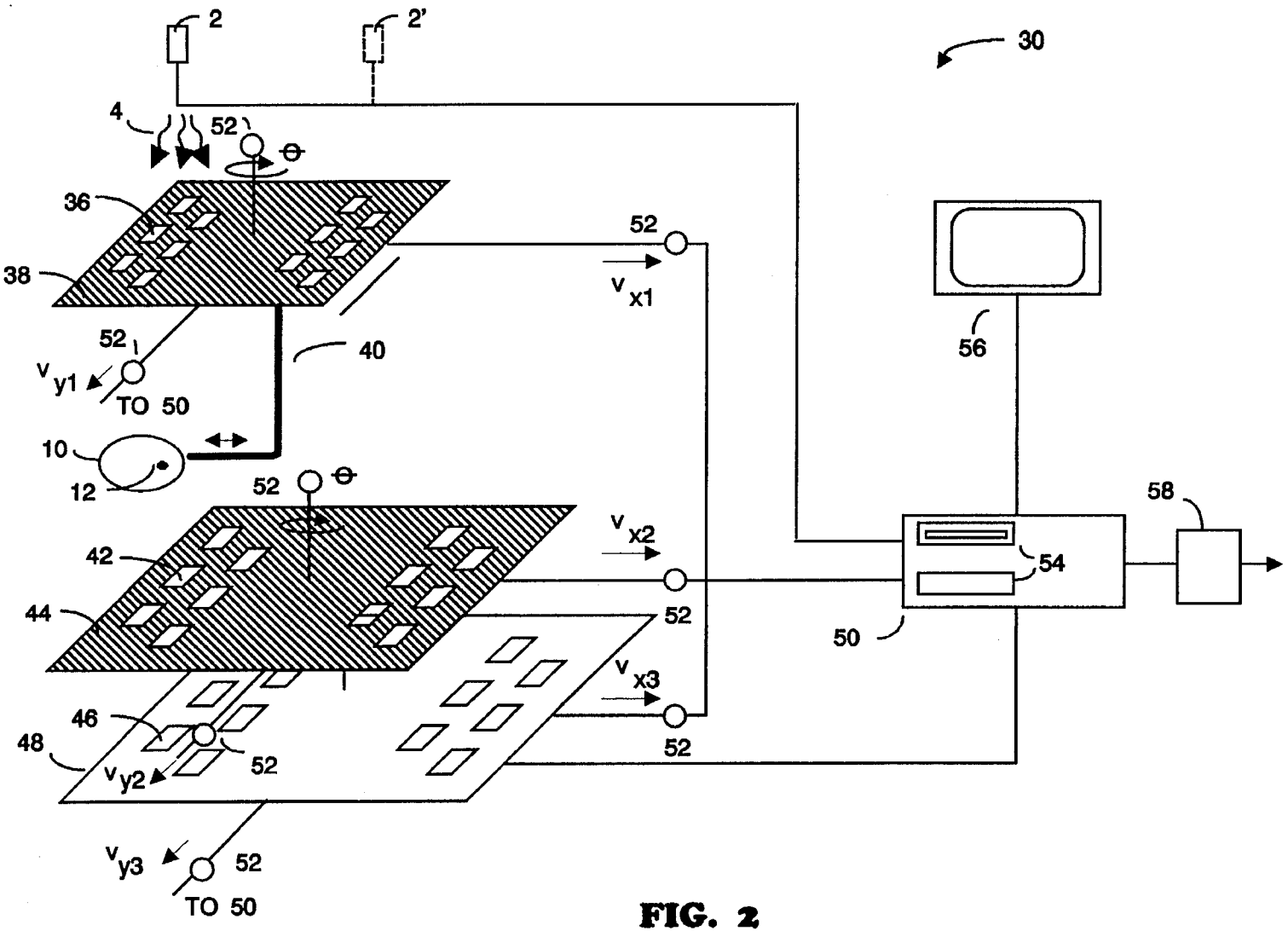
FIG. 2 depicts an enhanced sensitivity, filmless X-ray imaging system with three-dimensional image capability, according to the present invention.

FIG. 2 depicts a filmless X-ray imaging system 30 with three-dimensional capability, according to the present invention. System 30 includes an X-ray source 2 that may be horizontally repositioned, physically or electronically, for example to a new position 2'. When used in a three-dimensional imaging mode, X-ray source 2 emits X-rays 4 that pass through a plurality of openings 36 in a horizontally repositionable upper collimator 38.

Optionally, a mechanical sensing mechanism (indicated schematically as 40) may be used to generate information to allow the upper and lower collimator and detector planes to follow the chest wall of the subject whose breast is object 10. Doing this can reduce the likelihood that targets 12 located adjacent the chest wall might not be suitably imaged. In FIG. 2, it is to be understood that the X-ray subject preferably is standing to the left of system 30, facing the system, with the breast 10 under examination located between the upper and lower collimator planes 38, 44. Of course, what it depicted in FIG. 2 could be rotated 90° to accommodate a patient prone position.

As will be seen, in the three-dimensional imaging mode, the present invention requires that a proportional set of vertical z-axis distances be maintained between planes defined by the X-ray source 2, the upper collimator 38, the lower collimator 44 and detector array 48.

X-rays passing through upper collimator 38 irradiate an object or patient to be X-rayed 10, which object may include suspicious tissue 12 or microcalcification 12, to be detected. Although a variety of objects 10 may be X-rayed, in the preferred embodiment the present invention is used for mammography X-raying. As such, object 10 includes a human breast, within which three-dimensional object one or more targets 12 may be present.

As will be described, virtually 100% of the radiation passing from the upper collimator 38, and neither absorbed nor scattered in object 10, passes through openings 42 in a horizontally repositionable lower collimator 44. Located beneath lower collimator 44 is a plurality of detectors 46 disposed in a horizontally repositionable detector array 48.

According to the present invention, the various collimator openings 36, 42 and the detector size 46 preferably are sized in each x-axis and y-axis dimension proportionally to the vertical z-axis distance separating the plane containing the X-ray source 2 and the plane containing the openings or detectors. The detectors are sized slightly larger due to the spread in the angles of the incoming X-rays, which spread depends upon the distance $z_3-z_2$. Further, although FIG. 2 shows a staggered arrangement of collimator openings and detector positions, other patterns or arrangements are also possible. However, the pattern of the openings and detector positions preferably is such that no dead or non-irradiated regions of object 10 occur. The openings and detector positions may be, but need not be, square or rectangular as shown in FIG. 2.

It will be appreciated from FIG. 2 that no X-ray film is used to detect radiation, detection being performed by detector array 48 (described later herein with reference to FIG. 5). Array 48 provides signals in response to incoming X-ray radiation, which signals are preferably read-out of the array under control of a computer system 50.

Preferably computer system 50 receives and processes detected signals from the detector array 48. The detected data may be stored (for example on fixed or removable storage media 54, e.g., magnetic, floptical storage), displayed on a high resolution monitor 56, and/or electronically transmitted, via modem or radio transmitter 58 to a remote site. At the remote site, the received data may be displayed on a monitor, for examination, perhaps by a radiologist specialist.

As noted, preferably system 30 is operated under control of a computer 50. For example, computer 50 can control signals to horizontal repositioning mechanisms 52, to cause proportional horizontal movement of collimators 38, 44, and detector array 48. As will be described, the horizontal movement is such that essentially all radiation passing through the openings in the upper collimator will pass through the openings in the lower collimator, and be detected.

Figure 1:
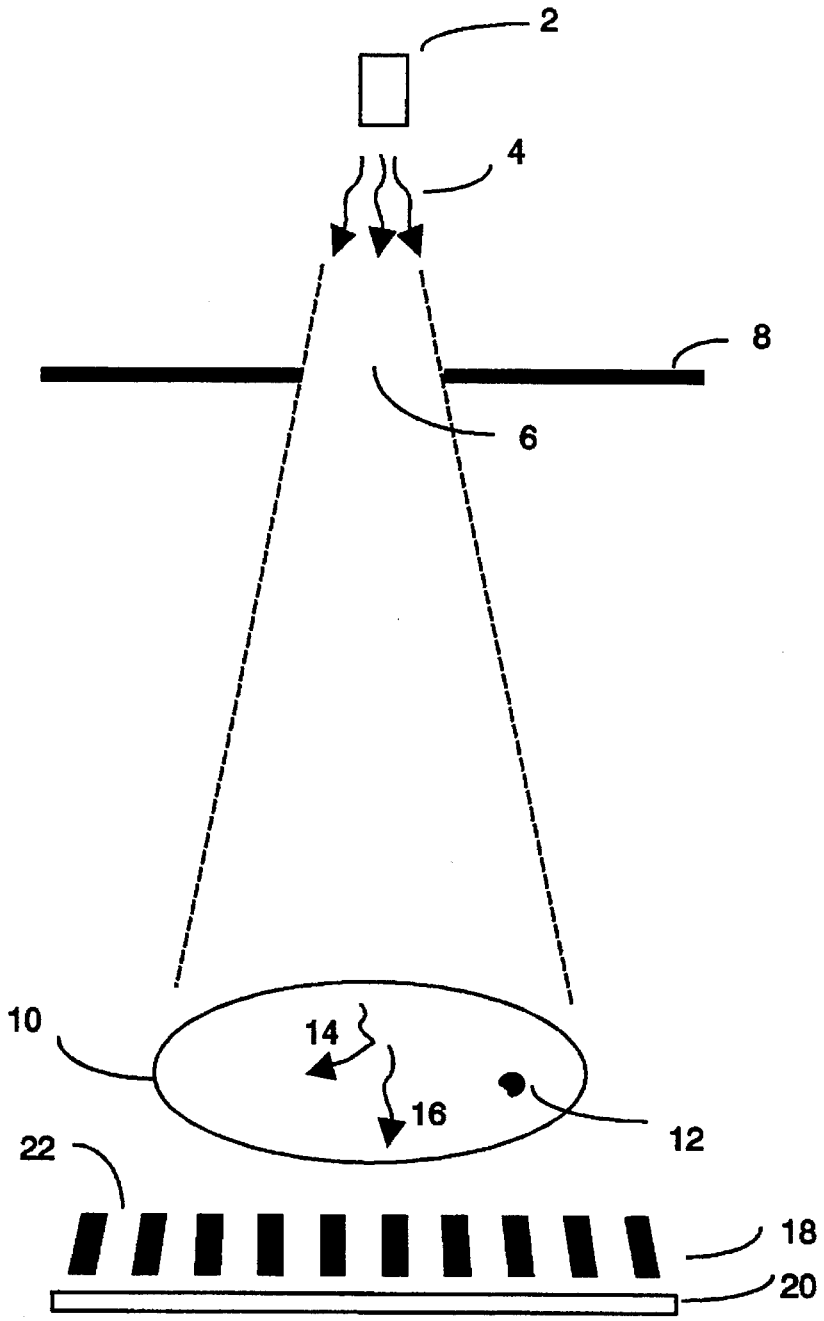
FIG. 1 (PRIOR ART)
FIG. 1 depicts an X-ray imaging system, according to the prior art.

In essence, all X-rays that have irradiated object 10 are detected and used. This is in stark contrast to the prior configuration of FIG. 1, wherein a substantial portion of rays that irradiated the object do not pass through the lower collimator to the underlying detection medium, or do pass through but go undetected.

In actual tests, using two fixed collimators, the present invention detected calcifications of less than 0.2 mm in size, a size smaller than what can be detected with prior art systems. Further, such improved detection can be made using less radiation dosage than prior art systems. Although it is generally believed that tissues containing certain calcifications as small as or smaller than 0.2 mm may be cancerous, this is unknown at present because until the present invention, such small sized targets could not be reliably detected.

Figure 3:
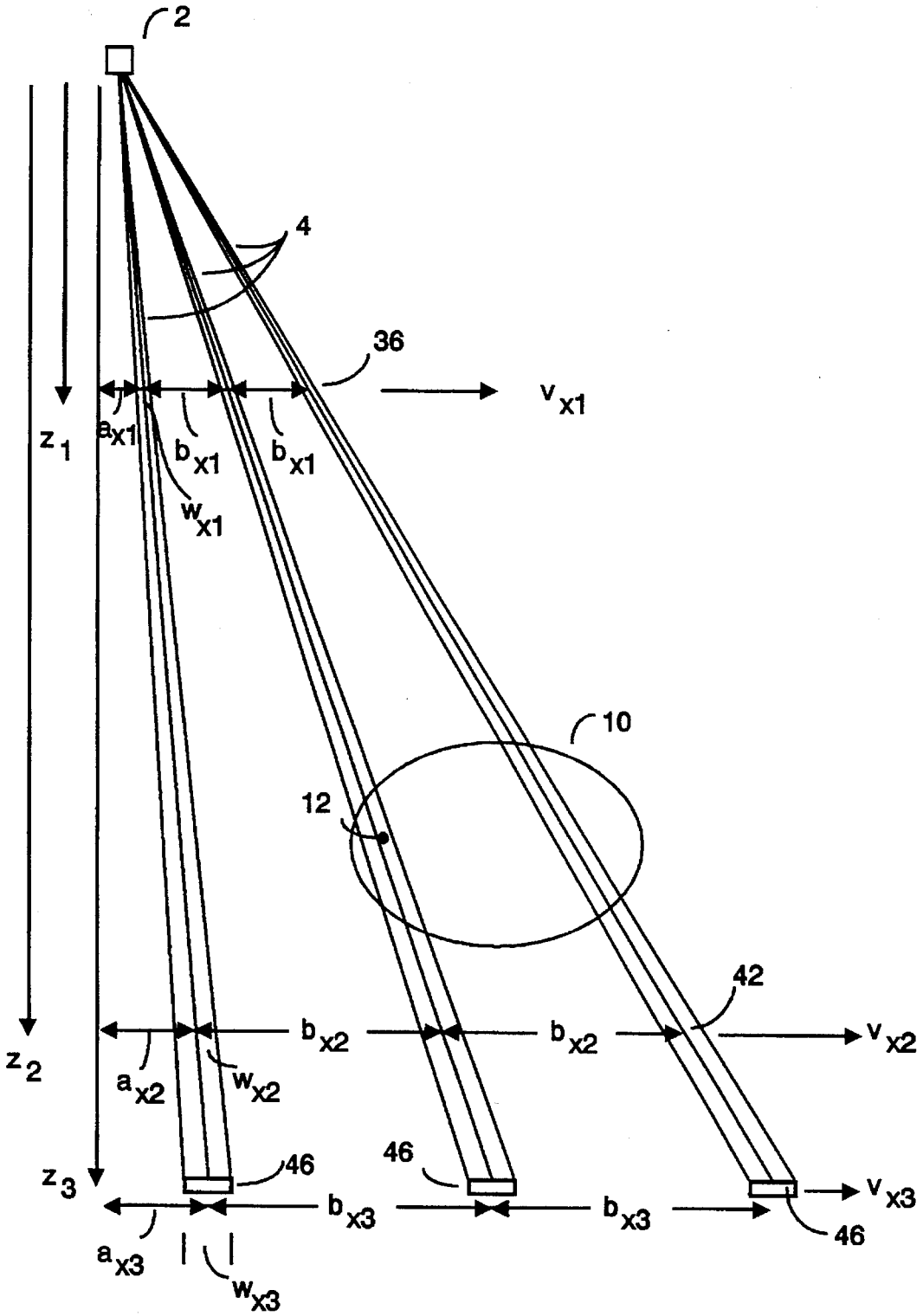
FIG. 3 depicts the proportional geometry and proportional scan velocities used in the present invention.

FIG. 3 depicts the proportional geometry and proportional scan velocities used in the present invention, showing movement along one axis, the x-axis. (It is understood that simultaneous proportional movement may also occur along the y-axis, and that planar rotation through an angle θ about the z-axis may also occur, if desired.)

In FIG. 3, the source of X-rays 2 lies on a first horizontal reference plane, located at z=0 on the vertical z-axis. The upper collimator 38 is a vertical distance $z_1$ beneath the reference plane, the lower collimator 44 is a vertical distance $z_2$ beneath the reference plane, with the detector array 48 being a vertical distance $z_3$ beneath the reference plane. In FIG. 3, for ease of illustration X-ray source 2 is considered as a point, umbra and penumbra spread in the X-rays are not shown, and upper and lower collimators 38, 44 are not shown. It is to be understood that X-rays 4 are depicted as passing through openings 36 in the upper collimator 38, openings 42 in lower collimator 44, and as impinging upon detectors 46 in detector array 48.

In FIG. 3, a constant horizontal distance $b_{x1}$ separates adjacent openings 36, center-to-center, in the upper collimator, and the horizontal offset to the center of the first opening 36 is dimension $a_{x1}$. A constant horizontal distance $b_{x2}$ separates adjacent openings 42, center-to-center, in the lower collimator 44, and the horizontal offset to the center of the first opening 42 is dimension $a_{x2}$. Finally, at the detector array 48, a constant horizontal distance $b_{x3}$ separates adjacent detectors 46, center-to-center, the horizontal offset to the center of the first detector 46 is dimension $a_{x3}$, and the horizontal width of a detector 46 is dimension $w_{x3}$. Again, similar positional relationships and nomenclature may exist along the y-axis dimension.

According to the present invention, the upper collimator 38, the lower collimator 44, and the detector array 48 are moved horizontally in the x-axis direction at respective velocities $v_{x1}$, $v_{x2}$, $v_{x3}$ that are proportional to the vertical distances $z_1$, $z_2$, $z_3$. Of course in the more general case, movement of these planes with respective velocities $v_{y1}$, $v_{y2}$, $v_{y3}$, again proportional to the vertical distances $z_1$, may occur, as can z-axis rotation through an angle θ. As shown in FIG. 2, these proportional movements are produced by mechanisms 52, preferably operating under control of computer system 50.

According to the present invention, depending upon which plane is under consideration, the horizontal offset (along the x-axis and/or y-axis) to the center of a first upper or lower collimator opening or detector $a_i$ is given by $a_i=v_i \cdot t$, where i=1, 2 or 3. Further, where $z_i$ is the vertical distance between the reference plane and the plane under consideration, $b_i$ is given by $b_i=b1\cdot(z_i/z1)$. The velocity $v_i$ of the various planes is given by $v_i=v_{x1}\cdot(z_i/z_1)$. Finally, the width $w_i$ of an upper or lower collimator opening or a detector size is given by $w_i=w_1\cdot(z_i/z_1)$. The detector size is further enlarged in proportion to $(z_3-z_2)\cdot(\tan\Phi-\tan\Phi')$, where Φ and Φ' represent the spread of X-ray angles, due to divergence of the X-ray beams in going from $z_2$ to $z_3$.

It follows then that the horizontal distance $x_{ij}$ (or $Y_{ij}$) to the center of the jth upper or lower collimator opening or detector on plane i is given by:

$$\begin{aligned} x_{ij} &= a_i + jb_i = v_i \cdot t + jb_i \\ &= v_1 \cdot (z_i/z_1) \cdot t + jb_1 \cdot (z_i/z_1) \\ &= (v_1 \cdot t + jb_1) \cdot (z_i/z_1). \end{aligned}$$

Because of the proportional geometry and proportional horizontal scanning velocities, similar triangles are formed, which causes similar upper collimator openings, lower collimator openings, and detectors (or detector positions) to stay aligned. Thus, as depicted in FIG. 3, essentially all X-rays passing through openings 36 in the upper collimator 38 will have an opportunity to irradiate the X-ray subject 10, and (if not absorbed or scattered) will pass through openings 42 in the lower collimator 44, impinge upon and be detected by the detectors 46.

The openings in the upper collimator may be used as a master to locate openings in the lower collimator, and detector positions. Of course, a reverse procedure could be used instead.

In contrast to the prior art configuration, essentially all X-rays that have irradiated the subject 10 that are not absorbed or scattered in the subject are detected, and none are wasted. It will be appreciated that for a given radiation dosage level, the configuration of FIG. 3 will provide better detection sensitivity because all of the radiation passing through the upper collimator is used. In practice, when used with the solid state detector array 48, the present invention can readily resolve targets 12 that are smaller than the smallest detected with prior art systems, and can do so using substantially lower radiation levels than required by prior art systems to detect larger targets 12.

Figure 4:
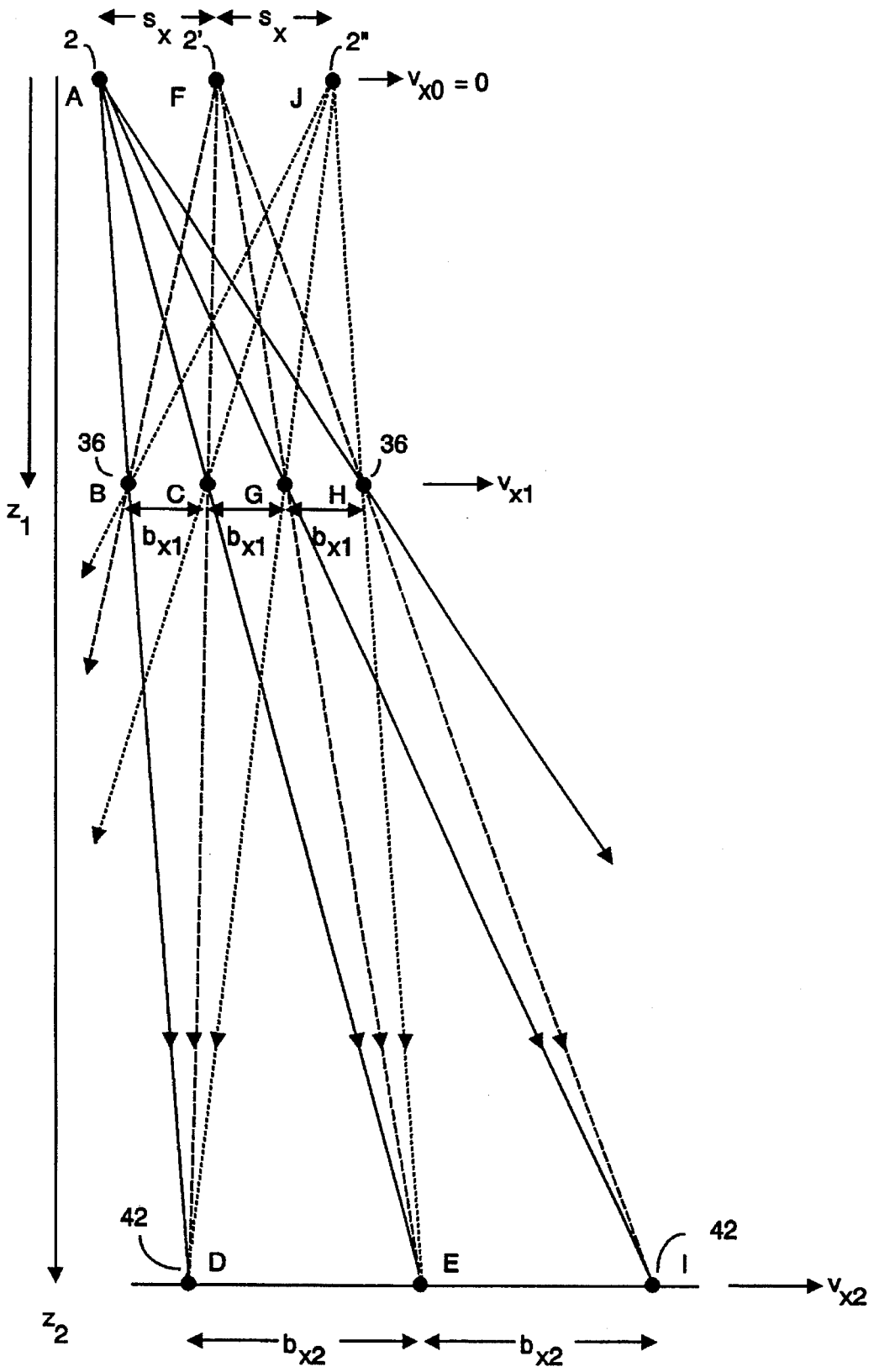
FIG. 4 depicts summation of multiple X-ray source radiation to produce multi-direction imaging, according to the present invention.

Turning now to FIG. 4, at the uppermost reference plane located at z=0, a plurality of X-ray source 2 focal spot positions are shown, denoted 2, 2', 2" Along the x-axis, a horizontal distance $s_x$ separates the spaced-apart positions, where $s_x=b_{x1}\cdot(z_2/[z_2-z_1])$. The multiple origins of X-ray source 2 may be implemented in several ways. For example, multiple electron beams and anodes within a common X-ray vacuum tube may be used, or a single electron beam may be directed sequentially from anode to anode, or from one anode track to another on a common anode structure, and then back again to repeat the scanning process.

Regardless of how the multiple X-ray origins are implemented, the horizontal repositioning by a distance $s_x$ will typically require less than 1 μs. This is substantially less than the time required for an opening in a collimator to be mechanically moved horizontally the width of the opening.

Consider the two triangles defined by points A-B-C, and A-D-E in FIG. 4. The collimator openings along the lines A-B-D and along A-C-E are aligned to receive radiation from X-ray source 2 at location A because of the proportional relationship between $a_{x1}$ and $a_{x2}$ (FIG. 3), and between $b_{x1}$ and $b_{x2}$. The triangle sides A-B-D and A-C-E will remain straight lines due to the proportional relationship between the velocities $v_{x1}$ and $v_{x2}$. As a result, the openings 36 in upper collimator 38 will remain aligned with the openings 42 in the lower collimator 44.

By similar reasoning, once the distance $s_x$ is found from triangles D-B-C and D-A-F, proportionality of $b_{x1}$ to $b_{x2}$ ensures that X-ray projection F-G will extend down to the center of the lower collimator opening at E, and that X-ray projection F-H extends to opening I, and so forth. Again, the proportional relationship $v_{x2}=v_{x1}\cdot(z_2/z_1)$ ensures that alignment is maintained.

In practice, a typical value for distance $s_x$ is perhaps a cm (although a closer spacing could be used). For three-dimensional imaging, the number of X-ray source positions is greater than one, with improvements in ambiguity resolution and Z spatial resolution occurring as the number increases. Although an array of X-ray positions could perhaps also be disposed along the y-axis, doing so is probably not feasible. The dimension $z_2$ is perhaps 65 cm, and $z_1$ will be approximately in the range 6 cm to 30 cm. Generally, the image size for a human breast is perhaps 10–30 cm, and generally the patient can be expected to remain still for perhaps 1 second. As a result, velocity $v_{x2}$ will be about 20 cm/second. Velocity $V_{1x}$, for example, will be a fraction of this velocity, namely in the ratio of the distance $z_1/z_2$, perhaps 1.8 cm/second to 9.2 cm/second in this example.

In FIG. 4, the detectors 46 are not shown. The detectors may be attached to the underside of the lower collimator 44 (e.g., $z_2=z_3$). Alternatively, the detectors may be disposed lower than the collimator plane, in which case the detectors will be larger in dimension than the collimator openings 42, and a similar set of proportional relations will ensure that alignment of the collimator openings and detectors is maintained. Placing the detectors some distance beneath openings 42 can aid in rejecting Compton scattering background.

Figure 5:
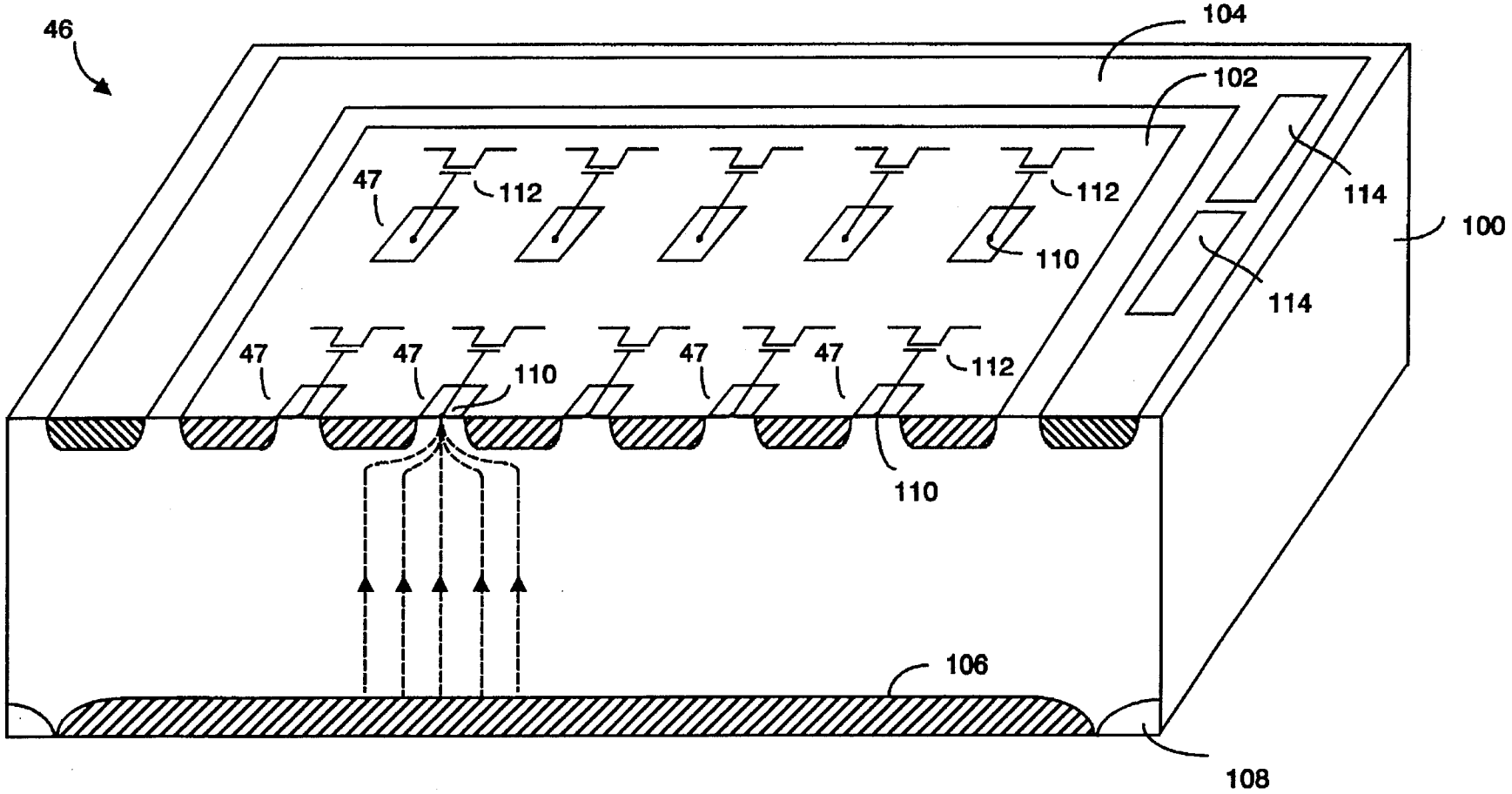
FIG. 5 is a simplified depiction of a detector array, according to the present invention.

FIG. 5 shows one detector chip 46, part of the detector array 48 as including a plurality of pixels 47 that are fabricated on a charge depletable P-type substrate 100 whose thickness is perhaps 300 μm. The upper surface of the substrate includes an N-well 102 and a CMOS readout region 104 that contains electronics 114 (schematically indicated by rectangles) to control and read data out from the array 48. The lower surface of the substrate includes an N-diffusion region 106 and, underlying this region, an electrode (not shown), and isolation regions 108. At the upper substrate surface, the N-well regions 102 separate P-type collection electrodes 110. Each P-type electrode is coupled to the gate input of one, and possibly more, metal-oxide-semiconductor ("MOS") transistors 112. (For ease of illustration, FIG. 5 depicts but a single MOS transistor 112 so coupled.) Of course, the P-type and N-type materials could be reversed. As used herein, the term "pixel" refers to one collection electrode 110, the MOS devices 112 associated therewith, and the associated underlying semiconductor structure in FIG. 5. As such, the term pixel may be used interchangeably with the term detector 47.

Such detectors are known in the art, and are described, for example, in U.S. Pat. No. 5,237,197 to W. Snoeys and to applicant, and in "A Proposed VLSI Pixel Device for Particle Detection", Nucl. Instr. and Meth. A275, 494 (1989), by applicant herein. Such detectors are also described in applicant's U.S. patent continuation application Ser. No. 07/831,131, filed Feb. 4, 1992. Applicant incorporates these references herein by reference.

In the detector of FIG. 5, the substrate 100 is preferably depleted through its entire 300 μm thickness, whereupon a plurality of P-I-N diodes are formed. The N-wells 102 are biased such that force lines emanate from the N-diffusion region 106 through the substrate thickness and focus upon the P-type collection electrodes 110. Incoming radiation (not shown) releases charge within the substrate, which charge is focused by the force lines and caused to be collected by the electrodes 110. N-wells 102 further serve as a Faraday shield for the array 48.

Notwithstanding that perhaps 90% of the upper surface of the detector array 46 is covered by other than detectors 47, efficiency is extremely high and more than 99.99% of the radiation-induced charges are collected by electrodes 110. Although detectors 47 occupy but about 10% of the upper surface of the array 46, they preferably are uniformly distributed on the surface, to provide resultant uniform array sensitivity and spatial resolution.

The collected charges remain at the gate input of the MOS devices 112 associated with the particular electrode 110, and may so remain until a reset device (not shown) or leakage removes the charge. It will be appreciated from FIG. 5 that the incoming charge is transmitted but a few microns from the electrode 110 to the gate(s) of device(s) 112. Because there is small capacitance (C) at the MOS gate, the charge (q) developed by the incoming X-ray radiation can produce a substantial input voltage signal (v), since v=q/C. The gate charge is then used to modulate readout current flowing through MOS device 112, which current is transmitted to associated detector row and column address circuitry located on the substrate. MOS device 112 is coupled to such circuitry, which preferably is controlled by electronics 114, which in the present invention may be operated under control of computer system 50. According to the present invention, since computer system 50 can record which detectors 47 have provided what X-ray radiation information at what time, three-dimensional imaging is provided.

In the present invention, detector 47 comprised 10×30 pixels, each 125 μm×34 μm, which provided an active area of about 1 $mm^2$. In the prototype detector used, the on-chip readout electronics was designed to take information from a few high energy particles tracks at a time, rather than from hundreds of thousands of X-rays. This prototype electronics integrated the charge collected by each detector, reporting out a total voltage shift, rather than providing fast output pulses for each detected X-ray. Data were recorded for a series of short time intervals during each X-ray pulse, interspersed with longer readout periods, whereupon the sequence was repeated. Although DC drift could occur, this procedure was used primarily to make use of an existing prototype detector array 46.

In the prototype, the 125 μm dimension was so sized to accommodate containing on-chip electronics to store charge while awaiting a readout trigger signal. Of course a smaller sized detector dimension may be used to provide a square detector intended primarily for X-ray detection. It is noteworthy, however, that even the 125 μm is smaller in size than the smallest calcifications seen with prior art systems. Further, although enhanced detection sensitivity can occur when the detector array is replicated and vertically stacked to stop and detect all incoming X-rays, in the test embodiment only a single layer array was used, as shown in FIG. 5.

Because they collect X-ray generated charge over a several hundred micron detector thickness, and because the well regions serve to focus essentially all radiation-created charge into the collection electrodes, detectors 47 can provide substantially greater sensitivity than other detectors, and because they may be small in size, such detectors can provide excellent spatial resolution.

Having described the preferred embodiment of system 30, some general comments are in order. In practice, calcification (e.g., 12) that are sufficiently small that their self-shielding of X-rays is insignificant, will absorb a constant fraction of X-rays, regardless of calcification shape as the X-ray direction is changed. This is because absorption is by individual atoms within the calcification. Because the present invention permits three-dimensional imaging, any calcifications that are isolated in two or more views, can be identified by the quantitative amount of their X-ray absorption.

In collecting test data, applicant placed a single detector 46 on top of the film holder assembly in a commercially available General Electric Senographe 600T X-ray system. A standard molybdenum anode focal track and filter were used, with a 0.3 mm focal spot to produce X-rays at highest intensity at 17.4 KeV. For comparison purposes, when the detector medium was a scintillating screen/film rather than applicant's solid state detector array, the lower collimator was a so-called Bucky collimator similar to lower collimator 18 in FIG. 1.

When testing the present invention, the X-ray beam was collimated using an upper collimator made from 3.21 mm thick brass with a 6.35 mm diameter opening, and a lower collimator made from 0.26 mm thick brass with a 12.7 mm diameter opening. A vertical distance of 63.8 mm separated the two collimators. Collimation reduced Compton scatter to a few percent of the direct X-ray beam, and simulated a system wherein sets of collimators produced scanned beams that match the size of the detecting array detectors, to minimize patient radiation dose.

In testing the detector array, a 2 mm thick cover of aluminum with a 2.5 mm diameter opening was placed immediately below the lower collimator, to form the integrated circuit chip cover for detector 46.

Object 10 and target 12 were provided by Radiation Measurements, Inc. ("RMI"). An RMI 156 accreditation phantom with a thickness of 35.9 mm acrylic and 7.7 mm wax was placed between the upper and lower collimators. The RMI aluminum oxide grains were initially placed on the upper collimator in place of grains embedded in the wax of the phantom. Doing so permitted measurement of the size of the grains. Data were also taken with the grains placed directly over the lower collimator. Data were also taken from calcifications in tissue samples from a tumor. The tissue was embedded in wax and the calcification region was centered on, and placed directly above the detector 46. In comparison testing, the tissue was placed on the Bucky collimator.

Before inserting the phantom, a light source that defined the edges of the X-ray illumination field was used to position the grains above the detector.

Incoming charge was summed in each pixel for a time ranging from 0.05 ms to 0.25 ms. The shorter times were used for runs to measure individual, normally non-overlapping X-rays, while the longer times were used for high-statistics runs below absorbing material. A 0.2 ms multiplexed readout of the 300 pixel heights into a TDS540 digital oscilloscope followed. The cycle was repeated about 30 times, the oscilloscope channels were switched, and the sequence repeated again before the X-ray beam went off. Digitized data were then transferred into a computer.

In such tests, the present invention detected and was used to produce images of test grains, with diameters of 0.16 mm, 0.25 mm and 0.32 mm, using initially a dosage of about 60–70 mA-sec. This is somewhat less than the typically 70–100 mA-sec used in the prior art for mammograms, which is a radiation dose to tissue of about 100 millirads. Stacking several detector arrays 100 to stop all of the X-rays would reduce the required exposure to about 37% of such dosage. Although the present invention could readily detect the smallest 0.16 mm grain, such was not the case in comparison testing using a scintillation screen/X-ray film medium.

Modifications and variations may be made to the disclosed embodiments without departing from the subject and spirit of the invention as defined by the following claims.

What is claimed is:

1. A filmless X-ray system, comprising:

means for emitting X-rays from at least two X-ray source-positions disposed on a reference plane with adjacent source-positions spaced-apart a distance $s_x$ along an X-axis of said reference plane;

an upper collimator plate disposed on a plane a distance $z_1$ beneath said reference plane and defining a first pattern of upper collimator openings spaced-apart a distance $b_{x1}$ along an X-axis of said upper collimator plate;

a lower collimator plate disposed on a plane a distance $z_2$ beneath said reference plane and defining a second pattern of at least two lower collimator openings spaced-apart center-to-center by a distance $b_{x2}$ along an X-axis of said lower collimator plate;

wherein said distance $s_x$ is defined by $s_x=b_{x1}\cdot(z_2/(z_2-z_1))$;

at least one X-ray detector unit having at least two detector locations and disposed on a plane a distance $z_3$ beneath said reference plane and defining a third pattern of detector locations spaced-apart center-to-center by a distance $b_{x3}$ along an X-axis of said X-ray detector unit;

wherein said $b_{x1}$, $b_{x2}$, $b_{x3}$ are respectively proportional to said $z_1$, $z_2$ and $z_3$;

means for repositioning said upper collimator plate with an X-axis velocity $v_{x1}$, said lower collimator plate with an X-axis velocity $v_{x2}$, and said X-ray detector unit with an X-axis velocity $v_{x3}$, each said velocity being proportional respectively to the distances $z_1$, $z_2$ and $z_3$;

wherein an object disposed between said upper and lower collimator planes and irradiated from said source-positions produces a pattern of X-ray radiation on said X-ray detector unit;

said X-ray system permitting identification of said source-positions and of positions of said upper collimator plate, said lower collimator plate, and said at least one X-ray detector unit such that information output by said X-ray detector unit is coupleable to a means for imaging said object.

2. The system of claim 1, wherein said object is a human breast, and further including means for maintaining constant distances between a chest wall associated with said human breast and said upper collimator plate, said lower collimator plate, and said detector locations.

3. The system of claim 1, wherein said at least one X-ray detector unit is selected from the group consisting of (a) a solid state pixel detector unit, and (b) a monolithic solid state pixel detector unit.

4. The system of claim 1, wherein each of said first pattern, said second pattern, and said third pattern is proportionally sized and spaced such that substantially all regions of said object receive said X-rays, and X-rays not absorbed or scattered by said object must pass through said lower collimator plate and enter said at least one detector unit.

5. A method for obtaining filmless imaging, comprising the following steps:

(a) disposing means for emitting X-rays from at least two X-ray source-positions on a reference plane with adjacent source-positions spaced-apart a distance $s_x$ along an X-axis of said reference plane;

(b) positioning an upper collimator plate disposed on a plane a distance $z_1$ beneath said reference plane and defining a first pattern of upper collimator openings spaced-apart a distance $b_{x1}$ along an X-axis of said upper collimator plate;

(c) positioning a lower collimator plate disposed on a plane a distance $z_2$ beneath said reference plane and defining a second pattern of at least two lower collimator openings spaced-apart center-to-center by a distance $b_{x2}$ along an X-axis of said lower collimator plate;

wherein said distance $s_x$ is defined by $s_x=b_{x1}\cdot(z_2/(z_2-z_1))$;

(d) providing at least one X-ray detector unit having at least two detector positions and disposed on a plane a distance $z_3$ beneath said reference plane and defining a third pattern of detector locations spaced-apart center-to-center by a distance $b_{x3}$ along an X-axis of said X-ray detector unit;

wherein said $b_{x1}$, $b_{x2}$, and $b_{x3}$ are respectively proportional to said $z_1$, $z_2$, and $z_3$;

wherein an object disposed between said upper and lower collimator planes and irradiated from said source-positions produces a pattern of X-ray radiation on said X-ray detection unit;

repositioning said upper collimator plate with an X-axis velocity $v_{x1}$, said lower collimator plate with an X-axis velocity $v_{x2}$, and said X-ray detector unit with an X-axis velocity $v_{x3}$, each said velocity being proportional respectively to the distances $z_1$, $z_2$, and $z_3$;

said X-ray system permitting identification of said source-positions and of positions of said upper collimator plate, said lower collimator plate, and said at least one X-ray detector unit such that information output by said X-ray detector unit is coupleable to a means for imaging said object.

6. The method of claim 5, wherein said object is a human breast, and including the further step of providing means for maintaining constant distances between a chest wall associated with said human breast and said upper collimator plate, said lower collimator plate, and said detector locations.

7. The method of claim 5, wherein said at least one X-ray detector unit includes:

a charge depletable substrate of lightly doped first conductivity type silicon having a first surface and a second surface;

a plurality of spaced-apart collection electrodes of highly doped first conductivity type material disposed adjacent said first surface;

a region of heavily doped second conductivity type material, adjoining said second surface of said substrate; and voltage-biasable doped well regions of second conductivity type material, disposed on said first surface between adjacent said collection electrodes and being sufficiently highly doped to act as an electrostatic shield for said charge depletable substrate and having a suitable doping level for any transistors within said voltage-biasable doped well regions; and transistor-containing circuits disposed within said voltage-biasable well regions for collecting charge released by interacting radiation from said collection electrodes and for transferring charge information out of said means for detecting;

wherein bias voltages coupled to said collection electrodes, said voltage-biasable doped well regions, and said second surface produce a depletion region in said substrate extending from said second surface toward and to said first surface, surrounding said voltage-biasable doped well regions and said collection electrodes, producing an electric field through said depletion region;

wherein said charge released by said interacting radiation is caused by said electric field to move to at least one of said collection electrodes.

8. The method of claim 5, wherein each of said first pattern, said second pattern, and said third pattern is proportionally sized and spaced such that substantially all regions of said object receive said X-rays, and X-rays not absorbed or scattered by said object must pass through said lower collimator plate and enter said at least one detector unit.

9. A system for three-dimensional filmless X-ray imaging, comprising:

an X-ray source disposed on a reference plane so as to emit X-rays at at least first and second source-positions, separated center-to-center by a distance $s_x$ along an X-axis of said reference plane;

an upper collimator disposed on a plane a distance $z_1$ beneath said reference plane and y defining a first pattern of openings spaced-apart a distance $b_x$;

a lower collimator disposed on a plane a distance $z_2$ beneath said reference plane and defining a second pattern of openings proportional in size and location to said first pattern of openings; and means for detecting X-rays, disposed on a plane a distance $z_3$ beneath said reference plane and defining a pattern of detector positions proportional in location and size to said first pattern of openings;

means for repositioning said upper collimator with a velocity $v_{x1}$ proportional to said distance $z_1$, said lower collimator with a velocity $v_{x2}$ proportional to said distance $z_2$, and said means for detecting with a velocity $v_{x3}$ proportional to said distance $z_3$;

wherein said distance $s_x$ is defined by $s_x=b_{x1}\cdot(z_2/[z_2-z_1])$ and X-rays from said source passing through a said opening in said upper collimator will pass through a corresponding said opening in said lower collimator and will impinge upon a corresponding one of said detector positions and be detected by said means for detecting;

wherein on object disposed between said upper and lower collimator is imaged by substantially all X-rays that pass through a said opening in said lower collimator.

10. The system of claim 9, further including processing means, coupled to said means for detecting, for imaging said object.

11. The system of claim 9, wherein said means for repositioning further repositions said upper collimator, said lower collimator and said means for detecting in an orthogonal direction with velocities $v_{y1}$, $v_{y2}$ and $v_{y3}$ respectively proportional to said $z_1$, $z_2$ and $z_3$.

12. The system of claim 9, wherein said means for repositioning further rotates said upper collimator, said lower collimator and said means for detecting about a z-axis normal to planes containing said upper collimator, said lower collimator and said means for detecting.

13. The system of claim 9, wherein each of said first pattern, said second pattern, and said third pattern is proportionally sized and spaced such that substantially all regions of said object receive said X-rays, and X-rays not absorbed or scattered by said object must pass through said lower collimator plate and enter said at least one detector unit.

14. The system of claim 9, wherein said means for detecting includes an array of detectors fabricated on a silicon substrate having a thickness of about 300 μm, said substrate being depleted over substantially all of said thickness.

15. The system of claim 9, wherein said means for detecting includes:

a charge depletable substrate of lightly doped first conductivity type silicon having a first surface and a second surface;

a plurality of spaced-apart collection electrodes of highly doped first conductivity type material disposed adjacent said first surface;

a region of heavily doped second conductivity type material, adjoining said second surface of said substrate;

voltage-biasable doped well regions of second conductivity type material, disposed on said first surface between adjacent said collection electrodes and being sufficiently highly doped to act as an electrostatic shield for said charge depletable substrate and having a suitable doping level for any transistors within said voltage-biasable doped well regions; and transistor-containing circuits disposed within said voltage-biasable well regions for collecting charge released by interacting radiation from said collection electrodes and for transferring charge information out of said means for detecting;

wherein bias voltages coupled to said collection electrodes, said voltage-biasable doped well regions, and said second surface produce a depletion region in said substrate extending from said second surface toward and to said first surface, surrounding said voltage-biasable doped well regions and said collection electrodes, producing an electric field through said depletion region;

wherein said charge released by said interacting radiation is caused by said electric field to move to at least one of said collection electrodes.

16. A method for three-dimensional filmless X-ray imaging, comprising the following steps:

positioning an X-ray source on a reference plane so as to emit X-rays at at least first second positions, said positions being separated center-to-center along an X-axis by a distance $s_x$ and along a Y-axis by a distance $s_y$;

locating an upper collimator, defining a first pattern of openings spaced-apart distances $b_{x1}$ and $by_1$ along respective X- and Y-axes of said upper collimator plate, on a plane a distance $z_1$ from said reference plane, and repositioning said upper collimator with a first vector velocity whose magnitude is proportional to said distance $z_1$;

locating a lower collimator, defining a second pattern of openings proportional in size and location to said first pattern of openings, on a plane a distance $z_2$ from said reference plane, and repositioning said lower collimator with a second vector velocity whose magnitude is proportional to said distance $z_2$; and locating a means for detecting X-rays, defining a pattern of detector positions proportional in location and size to said first pattern of openings, on a plane a distance $z_3$ from said reference plane, and repositioning said means for detecting X-rays with a third vector velocity whose magnitude is proportional to said distance $z_3$;

wherein said first vector velocity, said second vector velocity, and said third vector velocity each have substantially identical instantaneous directions;

wherein said distance $s_x$ is defined by $s_x=b_{x1}\cdot(z_2/[z_2-z_1])$, and said distance $s_y$ is defined by $s_y=b_{y1}\cdot(z_2/[z_2-z_1])$;

wherein X-rays from said X-ray source passing through a said opening in said upper collimator will pass through a corresponding said opening in said lower collimator and will impinge upon a corresponding one of said detector positions and be detected by said means for detecting X-rays;

wherein on object disposed between said upper and lower collimator is imaged by substantially all X-rays that pass through a said opening in said lower collimator.

17. The method of claim 16, including the further step of processing data from said means for detecting to image said object.

18. The method of claim 16, wherein said object is a human breast, and including the further step of providing means for maintaining constant distances between a chest wall associated with said human breast and said upper collimator plate, said lower collimator plate, and said detector locations.

19. The method of claim 16, wherein each said first pattern, said second pattern, and said third pattern is proportionally sized and spaced such that substantially all regions of said object receive said X-rays, and X-rays not absorbed or scattered by said object must pass through said lower collimator plate and enter said at least one detector unit.

20. The method of claim 16, including the further step of repositioning said upper collimator, said lower collimator and said means for detecting in an orthogonal direction with velocities $v_{y1}$, $v_{y2}$ and $v_{y3}$ respectively proportional to said $z_1$, $z_2$ and $z_3$.

21. The method of claim 16, including the further step of rotating said upper collimator, said lower collimator and said means for detecting about a z-axis normal to planes containing said upper collimator, said lower collimator and said means for detecting.

22. The method of claim 16, wherein said step of locating a means for detecting includes locating an array of detectors fabricated on a silicon substrate having a thickness, said substrate being depleted over substantially all of said thickness.

23. The method of claim 16, wherein said means for detecting includes:

a charge depletable substrate of lightly doped first conductivity type silicon having a first surface and a second surface;

a plurality of spaced-apart collection electrodes of highly doped first conductivity type material disposed adjacent said first surface;

a region of heavily doped second conductivity type material, adjoining said second surface of said substrate;

voltage-biasable doped well regions of second conductivity type material, disposed on said first surface between adjacent said collection electrodes and being sufficiently highly doped to act as an electrostatic shield for said charge depletable substrate and having a suitable doping level for any transistors within said voltage-biasable doped well regions; and transistor-containing circuits disposed within said voltage-biasable well regions for collecting charge released by interacting radiation from said collection electrodes and for transferring charge information out of said means for detecting;

wherein bias voltages coupled to said collection electrodes, said voltage-biasable doped well regions, and said second surface produce a depletion region in said substrate extending from said second surface toward and to said first surface, surrounding said voltage-biasable doped well regions and said collection electrodes, producing an electric field through said depletion region;

wherein said charge released by said interacting radiation is caused by said electric field to move to at least one of said collection electrodes.

* * * * *